United States Patent [19]

Hoberman

[11] Patent Number: 4,981,732

[45] Date of Patent: Jan. 1, 1991

[54] REVERSIBLY EXPANDABLE STRUCTURES

[76] Inventor: Charles Hoberman, 472 Greenwich St., New York, N.Y. 10013

[21] Appl. No.: 482,369

[22] Filed: Feb. 20, 1990

[51] Int. Cl.[5] ..... A63H 33/16

[52] U.S. Cl. ..... 428/12; 428/181; 428/542.2; 428/542.8; 446/488

[58] Field of Search ..... 428/9, 12, 121, 542.2, 428/542.8, 181; 446/117, 487, 488

[56] References Cited

U.S. PATENT DOCUMENTS

| | | | |
|---|---|---|---|
| 1,802,101 | 4/1931 | Wood | 428/542.8 X |
| 1,944,696 | 1/1934 | Reichl | 428/12 X |
| 1,997,022 | 4/1935 | Stalker | 428/542.8 X |
| 2,164,966 | 7/1939 | Tutein | 428/181 X |
| 2,922,239 | 1/1960 | Glynn, Jr. | 428/9 |
| 3,302,321 | 2/1967 | Walker | 428/12 X |
| 3,945,561 | 3/1976 | Strebelle | 428/542.8 X |
| 4,140,317 | 2/1979 | Ramney | 428/33 X |
| 4,142,321 | 3/1979 | Coppa | 428/542.2 X |
| 4,492,723 | 1/1985 | Chadwick, II | 428/7 |
| 4,780,344 | 10/1988 | Hoberman | 428/12 |

*Primary Examiner*—Henry F. Epstein

*Attorney, Agent, or Firm*—Sprung Horn Kramer & Woods

[57] ABSTRACT

Self-supporting structures of diverse shapes are disclosed that may be collapsed down to a compact bundle. In them, units are employed that are comprised of a central tapered strip bordered by two elongated strips. The tapered strip is pleated along a series of lines that cross it widthwise and each elongated strip is pleated along a series of lines that cross it widthwise. The central tapered strip is joined to each of the two elongated strips by a series of pleat lines that are connected end-to-end. When the unit is folded, each of the two elongated strips fold into a stack, and the central tapered strip folds in a zig-zag fashion, such that the planes of the tapered strip lie essentially orthogonal to the planes of the stacked elongated strips. The two stacked elongated strips fold towards each other, such that the stacks lie in line with one another.

8 Claims, 11 Drawing Sheets

REVERSIBLY EXPANDABLE STRUCTURES

BACKGROUND OF THE INVENTION

The present invention relates to the provision of firm stable three-dimensional expanded structures, that are capable of being collapsed down to compact bundles.

There are many times when one wishes to have an enclosure at a remote site and, rather that transport it to such site, one transports it in some collapsed form. Thus, a tent is folded up, transported and erected where needed. A fabric tent, however, has no rigidity and it is therefore necessary to utilize tent poles, pegs, and rope to give the tent some degree of rigidity. Further, it must be set on a reasonably firm sub-surface.

Pneumatically inflatable enclosures are another option for such a portable enclosure, but again substantial preparation is required.

The present invention provides reasonably rigid three dimensional enclosures that may be readily collapsed and expanded. These structures are made up of units which are comprised of facets that are connected by pleats or hinges. This invention has many desirable characteristics:

First, they fold down to a very compact bundle. Given the size of the structure's basic facet, the collapsed structure will essentially consist of a stack whose area is the size of that facet and whose height is the sum of the thicknesses of all the facets in the structure.

Second, it is possible to construct a wide variety of shapes and forms utilizing this method. Illustrated herein are such shapes as planes, cylindrical sections, cones, tent shapes, and doubly curved surfaces. This variety of forms allows for many different uses.

Third, many of the forms and shapes that can be made may be constructed from a single flat sheet of material that is scored or pleated. Because only a single flat sheet is required, many low cost manufacturing techniques may be employed, such as stamping, simple molds, etc.

Fourth, this method allows for utilizing materials of finite thickness. Plastics, wood, metal and other rigid materials may be employed for making structures that require more permanance and rigidity.

BRIEF SUMMARY OF THE INVENTION

Self-supporting structures of diverse shapes are disclosed that may be collapsed down to a compact bundle. Structures of this kind are comprised by units which are comprised of central tapered strips that are bordered by elongated strips. By pleating these strips according to a special pattern, the structure may collapse down and expand out in a smooth manner.

BRIEF DESCRIPTION OF THE DRAWING FIGURES

The invention will be further described described with reference to the accompanying drawings, wherein.

DETAILED DESCRIPTION

Figure 1:
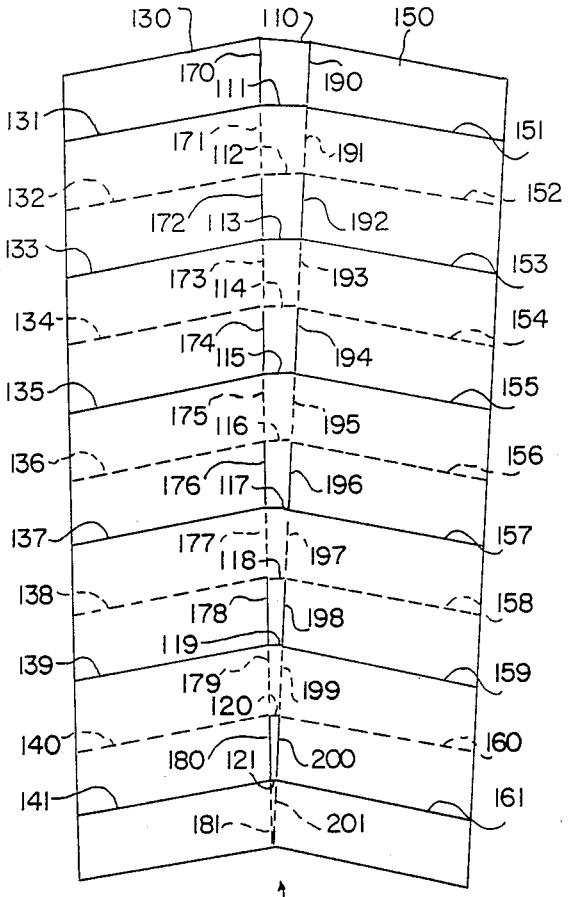
FIG. 1 is a plan view showing the basic unit of the invention.

Referring now more particularly to the drawings, in FIG. 1 there is shown a unit 100 comprised of a central tapered strip 110 which is bordered by two elongated strips 130 and 150. Tapered strip 110 is pleated along a series of crossing lines 111–121 that cross it widthwise. The fold directions of adjacent crossing lines alternate.

Elongated strip 130 is pleated along a series of crossing lines 131–141 that cross it widthwise. The fold direction of adjacent crossing lines alternate. Crossing line 131 is essentially a continuation of crossing line 111. Similarly, crossing lines 132–141 are essentially continuations of crossing lines 112–121 respectively.

Elongated strip 150 is pleated along a series of crossing lines 151–161 that cross it widthwise. The fold direction of adjacent crossing lines alternate. Crossing line 151 is essentially a continuation of crossing line 111. Similarly, crossing lines 152–161 are essentially continuations of crossing lines 112–121 respectively.

Central tapered strip 110 is connected to elongated strip 130 along a series of connecting pleat lines 170–181 that are connected end to end. The fold direction of adjacent connecting lines 170–181 alternate. Similarly, central tapered strip 110 is connected to elongated strip 150 along a series of connecting pleat lines 190–201 that are connected end to end. The fold direction of adjacent connecting lines 190–201 alternate.

Figure 2:
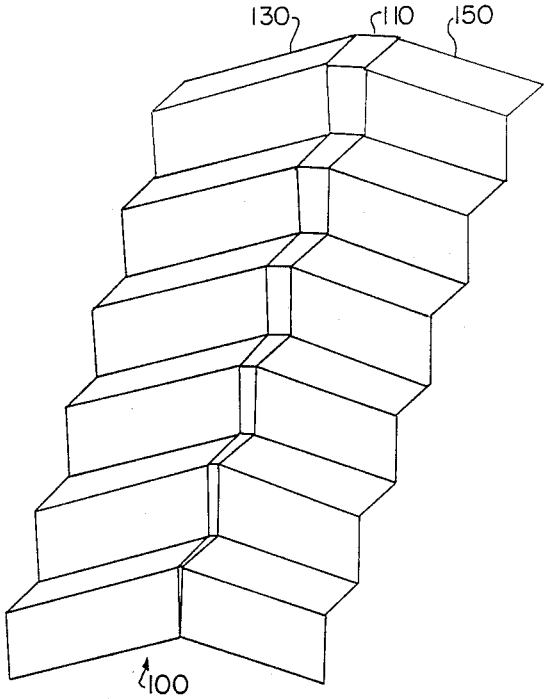
FIGS. 2–4 are perspective views of the unit shown in FIG. 1, as it is folded down to its fully collapsed state.

In FIG. 2, unit 100 is shown partially folded. Central tapered strip 110 and elongated strips 130 and 150 fold in a zig-zag fashion.

Figure 3:
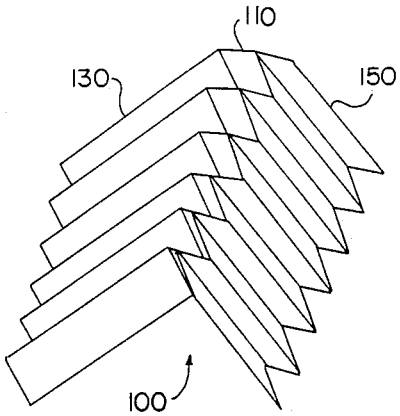

In FIG. 3, unit 100 is shown folded to a further degree than FIG. 2. Elongated strips 130 and 150 may be seen to fold towards each other.

Figure 4:
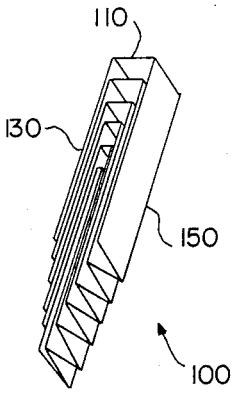

In FIG. 4 unit 100 is shown to be essentially completely folded. Elongated strips 130 and 150 have each folded into a stack. The central tapered strip 110 has folded in a zig-zag fashion, such that the planes of the tapered strip lie essentially orthogonal to the planes of the stacked elongated strips 130 and 150. Stacked elongated strips 130 and 150, have folded towards each other such that the stacks lie essentially in line with one another.

Figure 5:
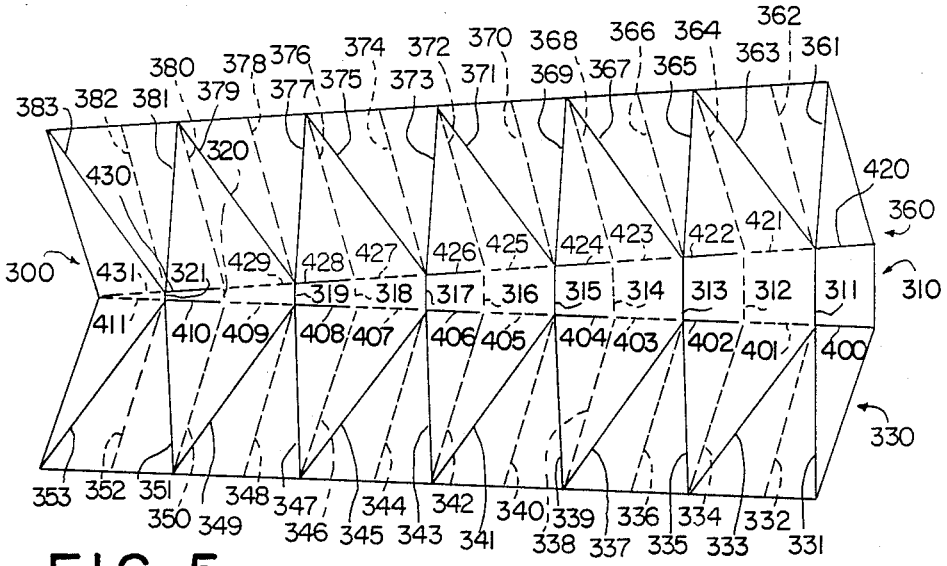
FIG. 5 is a plan view showing an alternate embodiment of the basic unit of the invention.

In FIG. 5 there is shown a unit 300 which is an alternate embodiment of the invention. It is comprised of a central tapered strip 310, which is bordered by two elongated strips 330 and 360. Tapered strip 310 is pleated along a series of crossing lines 311–321 that cross it widthwise. The fold directions of adjacent crossing lines alternate.

Elongated strip 330 is pleated along a series of crossing lines 331–353 that cross it widthwise. The fold directions of adjacent crossing lines alternate. Crossing line 331 is essentially a continuation of crossing line 311. Similarly, crossing lines 332–353 are essentially continuations of crossing lines 311–321.

Elongated strip 360 is pleated along a series of crossing lines 361–383 that cross it widthwise. The fold directions of adjacent crossing lines alternate. Crossing line 361 is essentially a continuation of crossing line 311. Similarly, crossing lines 362–383 are essentially continuations of crossing lines 311–321.

Central tapered strip 310 is connected to elongated strip 330 along a series of connecting pleat lines 400–411 that are connected end to end. The fold directions of adjacent connecting lines 400–411 alternate. Similarly, central tapered strip 310 is connected to elongated strip 360 along a series of connecting pleat lines 420–431 that are connected end to end. The fold directions of adjacent connecting lines 420–431 alternate.

Figure 6:
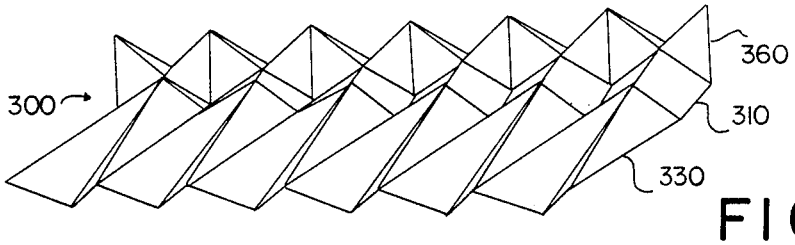
FIGS. 6–8 are perspective views of the unit shown in FIG. 5, as it is folded down to its fully collapsed state.

In FIG. 6, unit 300 is shown partially folded. Central tapered strip 310 folds in a zig-zag fashion.

Figure 7:
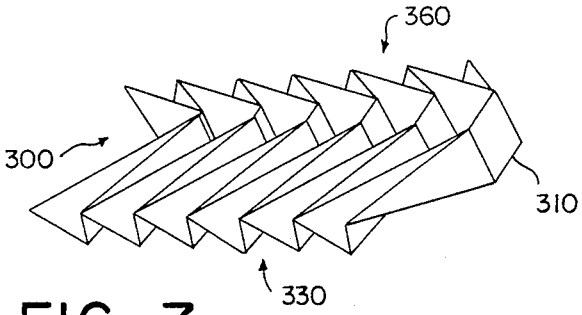

In FIG. 7, unit 300 is shown folded to a further degree than FIG. 6. Elongated strips 330 and 360 may be seen to fold towards each other.

Figure 8:
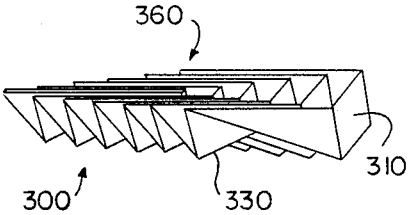

In FIG. 8 unit 300 is shown to be essentially completely folded. Elongated strips 330 and 360 have each folded into a stack. The central tapered strip 310 has folded in a zig-zag fashion such that the planes of the central tapered strip lie essentially orthogonal to the planes of the stacked elongated strips 330 and 360. In FIG. 8 stacked elongated strips 330 and 360 have folded towards each other such that the stacks lie essentially in line with one another.

Figure 9:
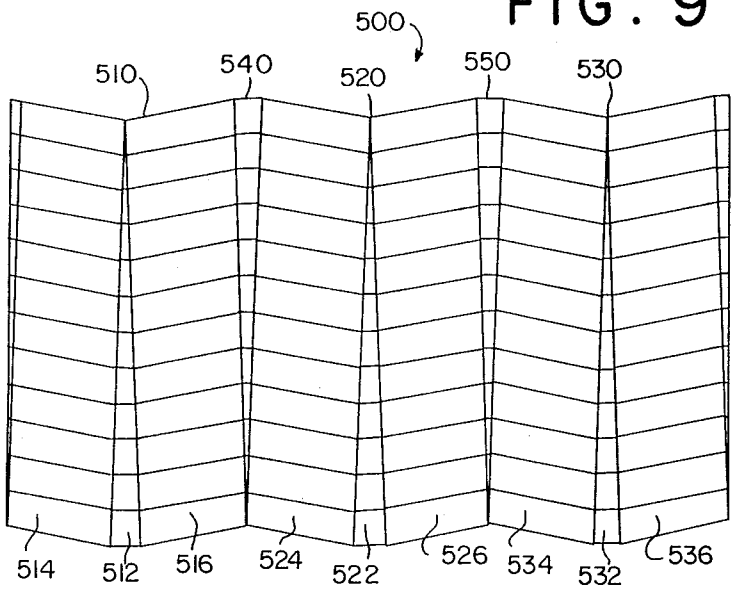
FIG. 9 is a plan view of a planar structure that is an embodiment of the invention.

In FIG. 9 structure 500 is comprised of units 510,520 and 530. Unit 510 is comprised of central tapered strip 512 and elongated strips 514 and 516. Similarly, unit 520 is comprised of central tapered strip 522 and elongated strips 524 and 526, while unit 530 is comprised of central tapered strip 532 and elongated strips 534 and 536. Unit 510 is connected to adjacent unit 520 by tapered strip 540 which joins elongated strip 516 to elongated strip 524. Similarly, unit 520 is connected to adjacent unit 530 by tapered strip 550 which joins elongated strip 526 to elongated strip 534.

Figure 10:
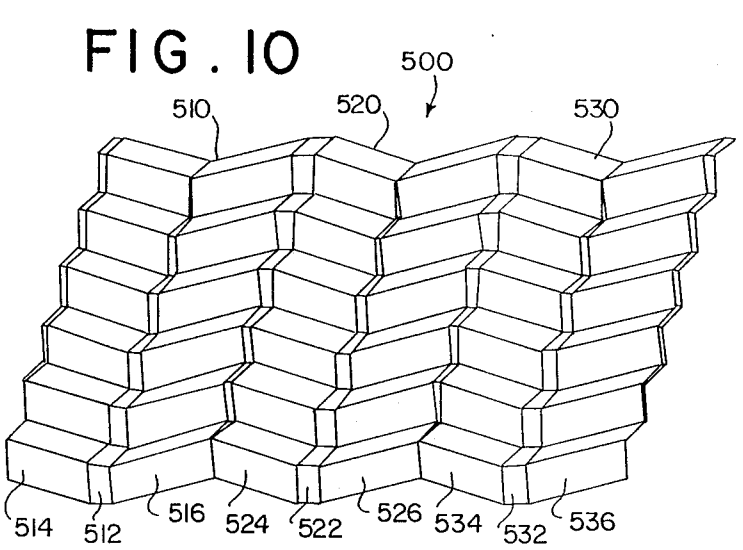
FIGS. 10–12 are perspective views of the structure shown in FIG. 9 as it is folded down to its fully collapsed state.
Figure 11:
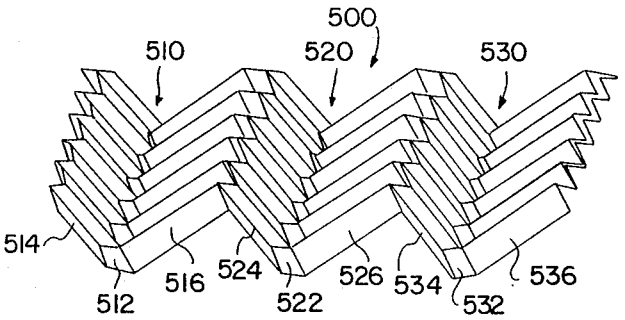

In FIGS. 10 and 11 the structure 500 is shown in two parial degrees of folding. The elongated strips 514,516,524,534 and 536 may be seen to fold towards each other. Tapered strips 512,522,532,540 and 550 fold in a zig-zag fashion.

Figure 12:
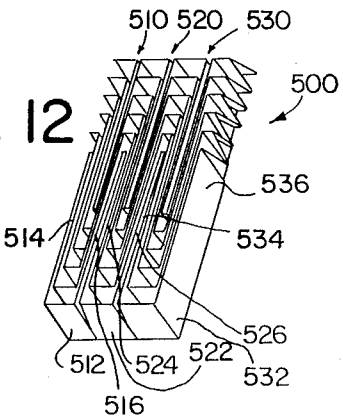

In FIG. 12 the structure 500 is shown completely folded. Elongated strips 514,516,524,526,534 and 536 are folded into stacks which are connected by their adjacent tapered strips. The tapered strips 512,522,532,540 and 550 are folded in a zig-zag fashion. The planes of the tapered strips lie essentially orthogonal to the planes of the stacked elongated strips. The stacks formed by the elongated strips lie essentially in line with one another.

Figure 13:
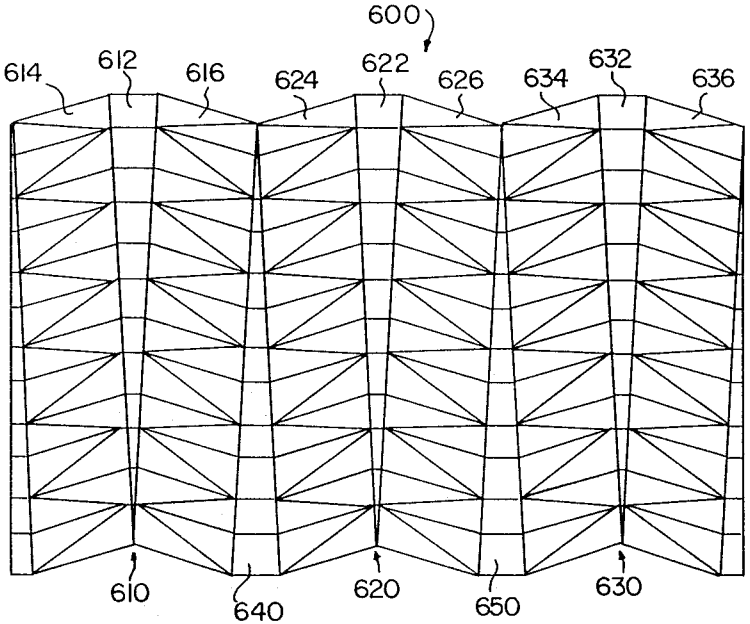
FIG. 13 is a plan view of a cylindrical structure that is an embodiment of the invention.

In FIG. 13 is shown a plan view of a structure 600. It is composed of units 610,620 and 630. Unit 610 is comprised of central tapered strip 612 and elongated strips 614 and 616. Similarly, unit 620 is comprised of central tapered strip 622 and elongated strips 624 and 626, while unit 630 is comprised of central tapered strip 632 and elongated strips 634 and 636. Unit 610 is connected to adjacent unit 620 by tapered strip 640, which joins elongated strip 616 to elongated strip 624. Similarly, unit 620 is connected to adjacent unit 630 by tapered strip 650 which joins elongated strip 626 to elongated strip 634.

Figure 14:
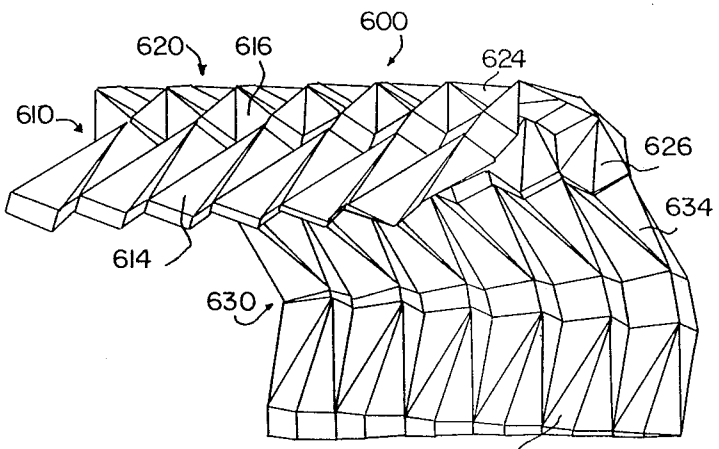
FIGS. 14–16 are perspective views of the structure shown in FIG. 13 as it is folded down to its fully collapsed state.
Figure 15:
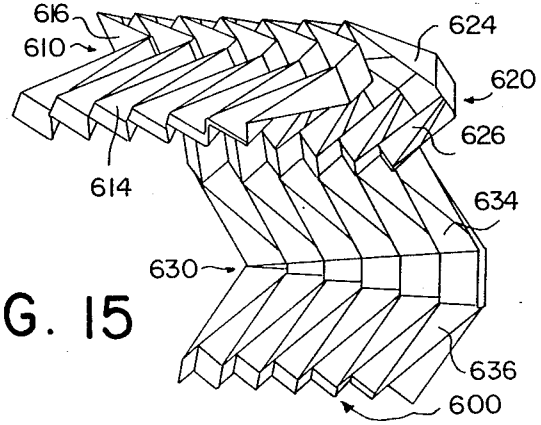

In FIGS. 14 and 15 the structure 600 is shown in two partial degrees of folding, forming a structure whose shape is a cylindrical section. The elongated strips 614,616,624,626,634 and 636 may be seen to fold towards each other. Tapered strips 612,622,632,640 and 650 fold in a zig-zag fashion.

Figure 16:
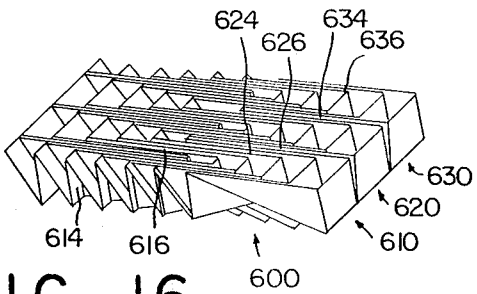

In FIG. 16 the structure 600 is shown essentially completely folded. Elongated strips 614,616,624,626,634 and 636 are folded into stacks which are connected by their adjacent tapered strips. The tapered strips 612,622,632,640 and 650 are folded in a zig-zag fashion. The planes of the tapered strips lie essentially orthogonal to the planes of the stacked elongated strips. The stacks formed by the elongated strips lie essentially in line with one another.

Figure 17:
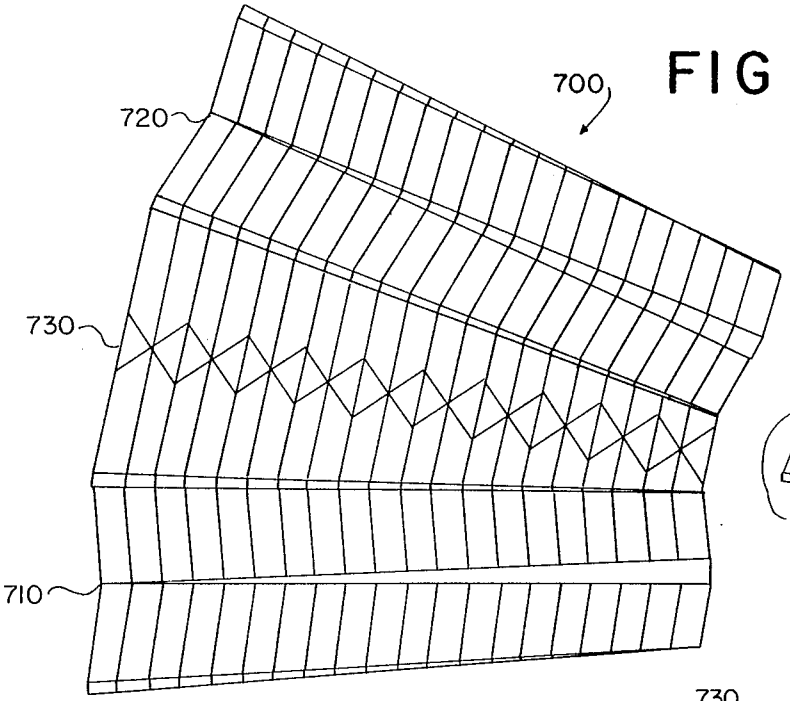
FIG. 17 is a plan view of a tent-shaped structure that is an embodiment of the invention.
Figure 18:
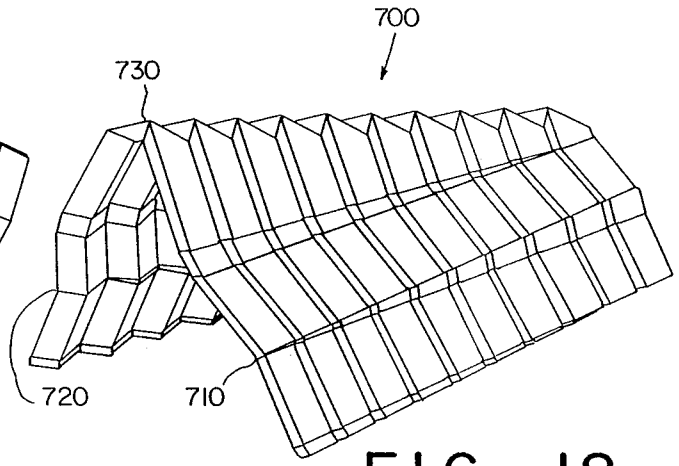
FIGS. 18–20 are perspective views of the structure shown in FIG. 17 as it is folded down to its fully collapsed state.
Figure 20:
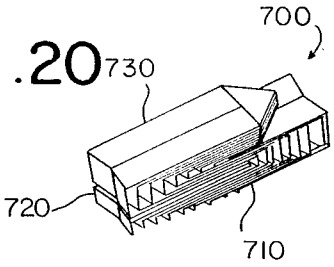
Figure 19:
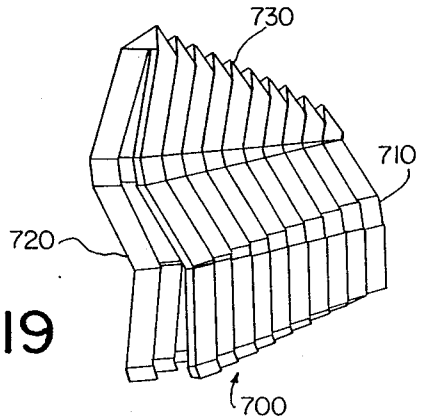

FIG. 17 showns a structure 700 comprised of two units 710 and 720, each comprised of a central tapered strip and two elongated strips. Units 710 and 720 are connected to each other by a region 730 with an alternate folding pattern. In FIG. 18, the structure 700 is shown in a partially folded condition, forming a tentshpaed structure 700 is shown in a partially folded condition, forming a tent-shaped structure. FIG. 19 shows the structure 700 folded to a further degree than FIG. 18. In FIG. 20 the structure 700 is shown essentially completely folded.

Figure 21:
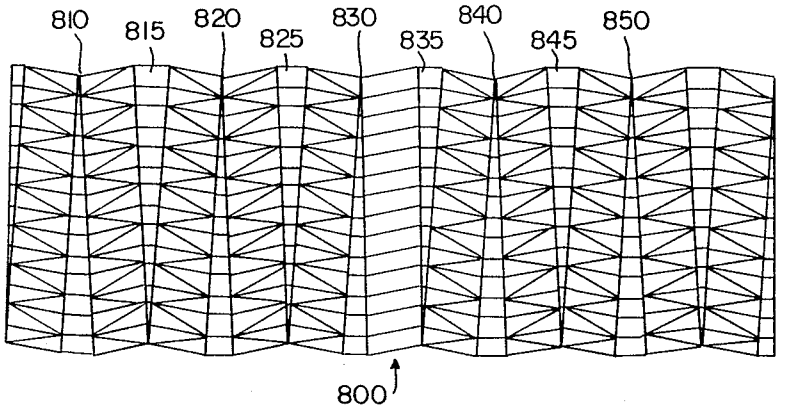
FIG. 21 is a plan view of a structure having an S-type curvature that is an embodiment of the invention.
Figure 22:
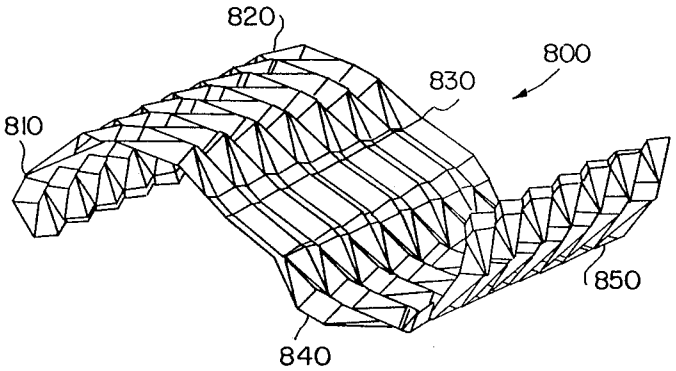
FIGS. 22–24 are perspective views of the structure shown in FIG. 21 as it is folded down to its fully collapsed state.
Figure 23:
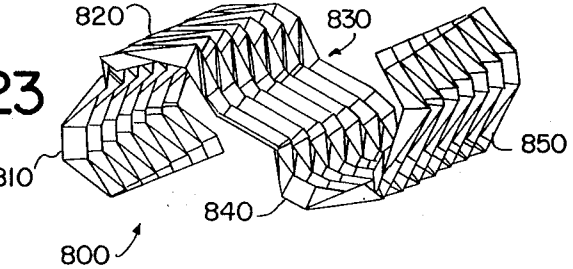
Figure 24:
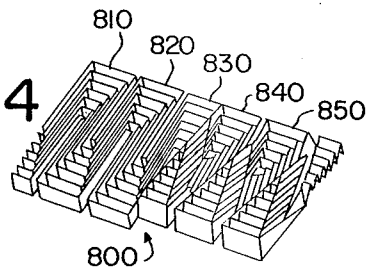

FIG. 21 shows a structure 800 comprised of five units 810,820,830, 840 and 850, each comprised of a central tapered strip and two elongated strips. Units 810,820,830,840 and 850 are connected to each other by tapered stips 815,825,835 and 845. In FIG. 22, the structure 800 is shown in a partially folded condition, forming a structure with an S-type curvature. FIG. 23 shows the structure 800 folded to a further degree than FIG. 22. In FIG. 24 structure 800 is shown essentailly completely folded.

Figure 26:
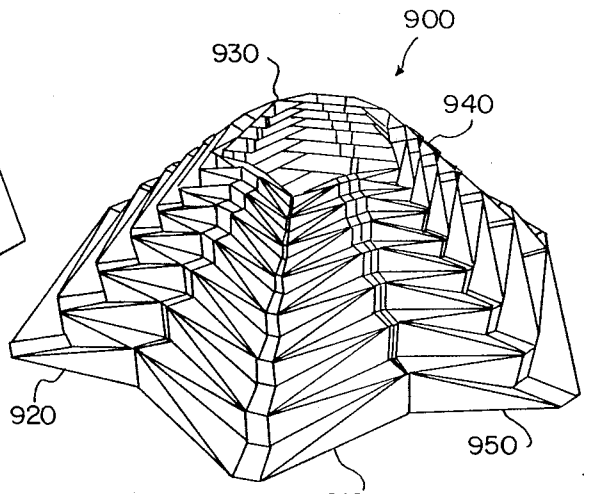
FIGS. 26–28 are perspective views of the structure shown in FIG. 25 as it is folded down to its fully collapsed state.
Figure 28:
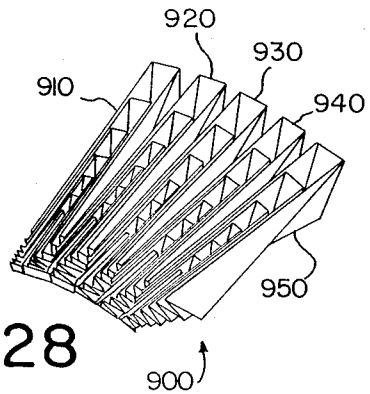
Figure 25:
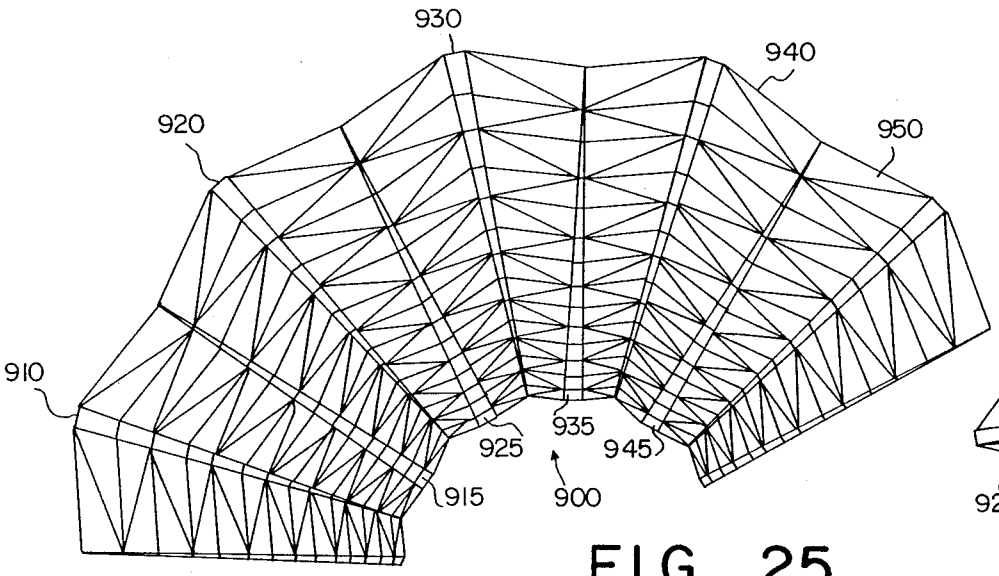
FIG. 25 is a plan view of a conical structure that is an embodiment of the invention.
Figure 27:
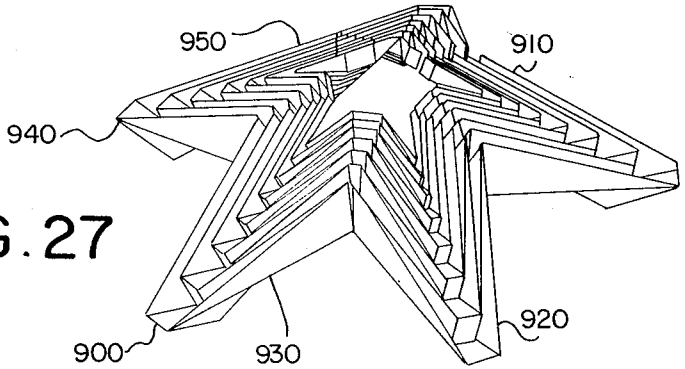

FIG. 25 shows a structure 900 comprised of five units 910,920,930 940 and 950, each comprised of a central tapered strip and two elongated strips. Units 910,920,930,940 and 950 are connected to each other by tapered strips 915,925,935 and 945. In FIG. 26 the structure 900 is shown in a partial folded condition, forming a conical structure. FIG. 27 showns the structure 900 folded to a further degree than FIG. 26. In FIG. 28 the structure 900 is shown essentially completely folded.

Figure 30:
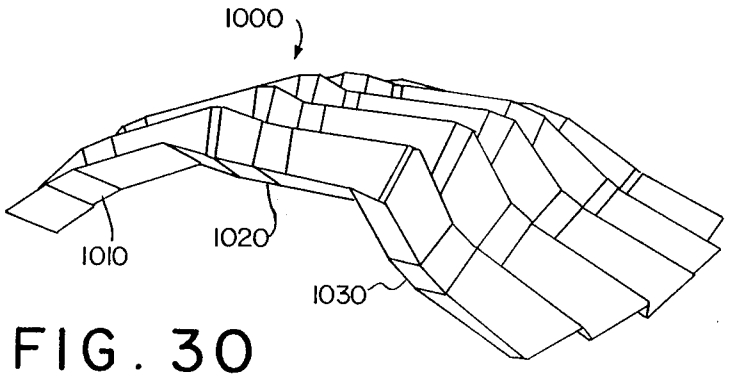
FIGS. 29–32 are perspective views of the structure having double curvature as it is folded from its fully developed state to its fully collapsed state.
Figure 32:
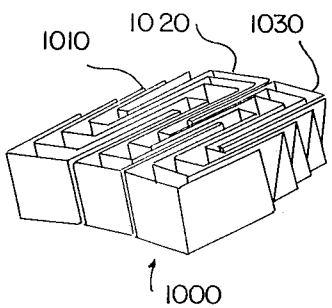
Figure 29:
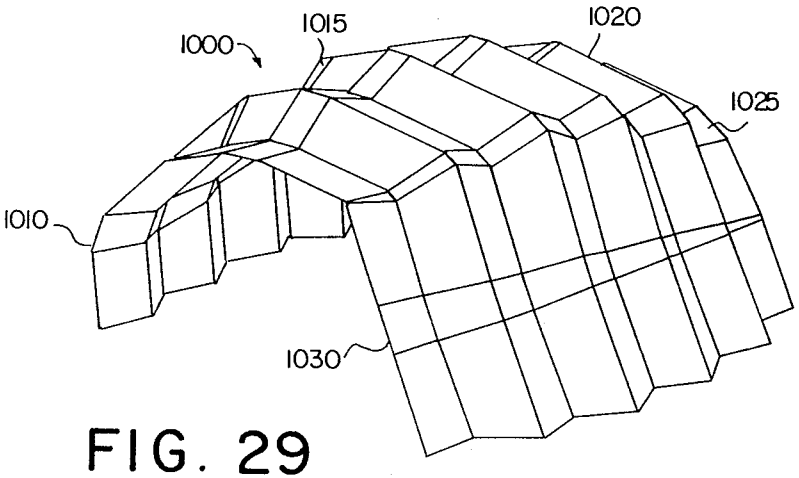
Figure 31:
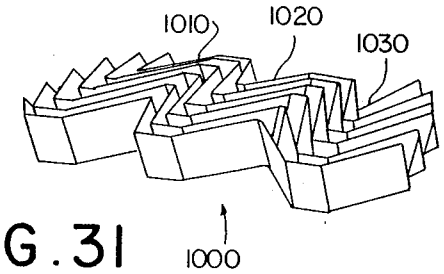

FIG. 29 shows a structure 1000 having the form of a doubly curved surface. It is comprised of three units 1010,1020 and 1030, each comprised of a central tapered strip and two elongated strips. Units 1010,1020 and 1030 are connected to each other by tapered strips 1015 and 1025. In FIG. 30, the structure 1000 is shown in a partially folded condition. FIG. 31 shows the structure 1000 folded to a further degree than FIG. 30. In FIG. 32 the structure 1000 is shown essentially completely folded.

Figure 33:
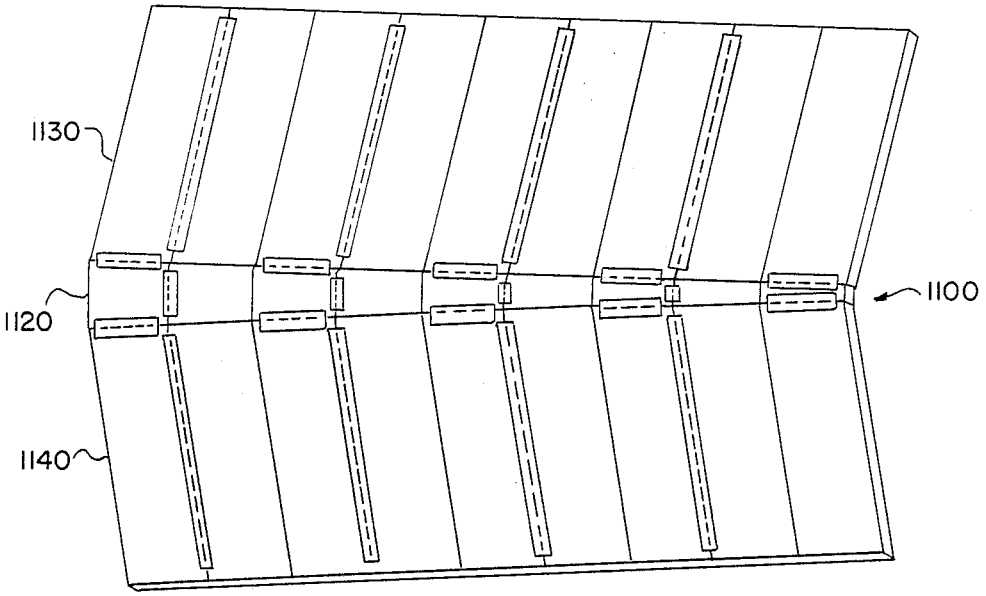
FIGS. 33–35 are perspective views showing an alternate construction of the basic unit of the invention, utilizing hinged rigid plates.
Figure 34:
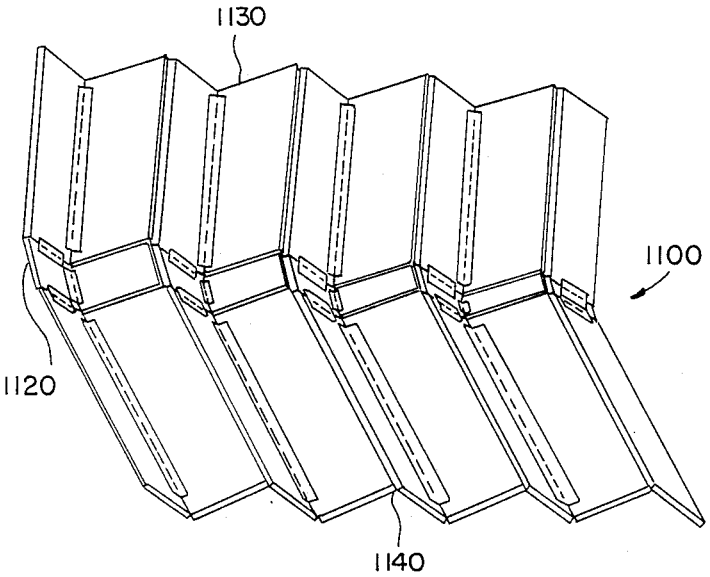
Figure 35:
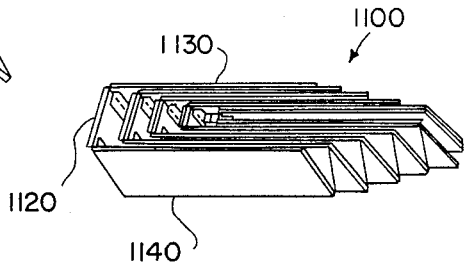

FIG. 33 shows the unt 1100 which illustrates an alternate construction of the invention. It is comprised by a central tapered strip 1120 which is bordered by two elongated strips 1130 and 1140. In this embodiment of the invention, the central strip 1120 is comprised of rigid plates which are hingedly attached to each other. Similarly elongated strips 1130 and 1140 are comprised of rigid plates which are hingedly attached to each other. Central strip 1120 is hingedly joined to elongated strips 1130 and 1140. FIG. 34 shows the unit 1100 in a partially folded state. FIG. 35 shows the unit 1100 in its fully collapsed state.

Figure 36:
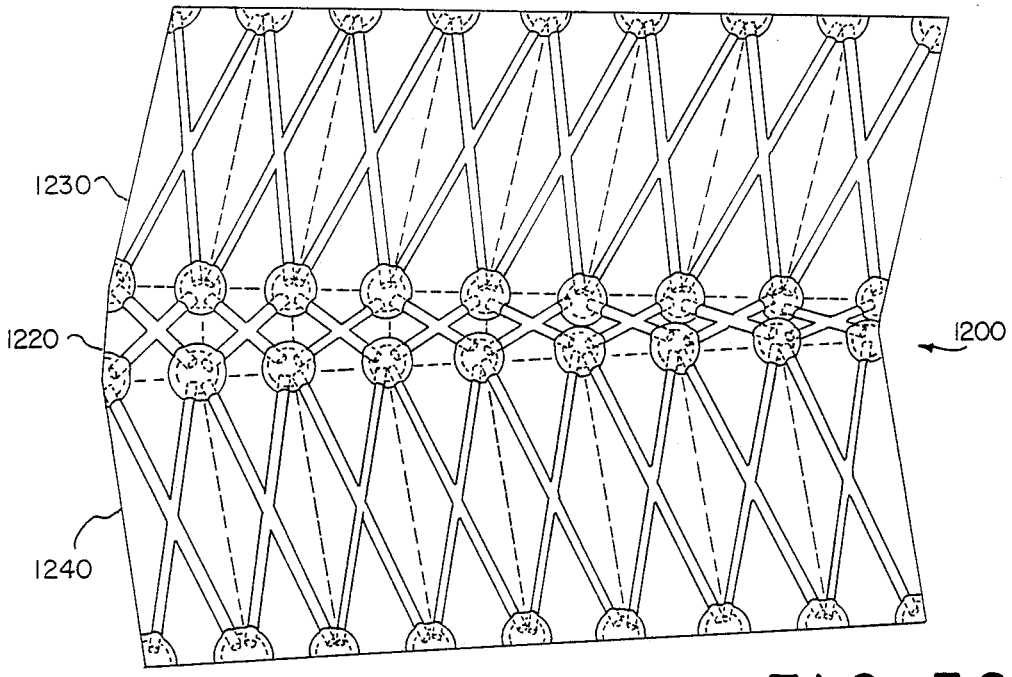
FIGS. 36–38 are views showing an alternate construction of the basic structural unit of the invention and that utilizes a flexible sheet with stiffening framing members.
Figure 37:
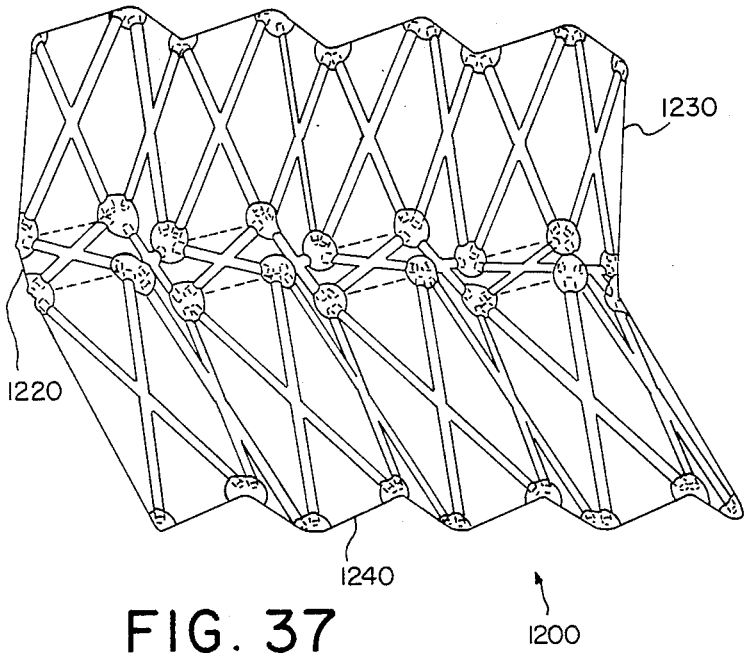
Figure 38:
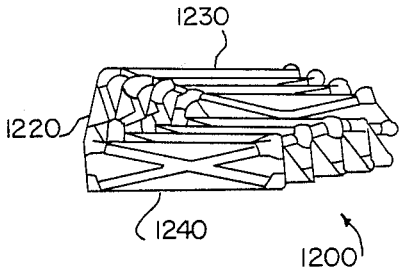

FIG. 36 shows the unit 1200 which illustrates an alternate construction of the invention. If is comprised by a central tapered strip 1120 which is bored by two elongated strips 1230 and 1240. In this embodiment of the invention the strips 1220,1230 and 1240 comprise flexible sheets of material where the area between pleat lines are stiffened by rigid framing members. FIG. 37 shows the unit 1200 in a partially folded state. FIG. 38 shows the unit 1200 in its fully collapsed state.

Figure 39:
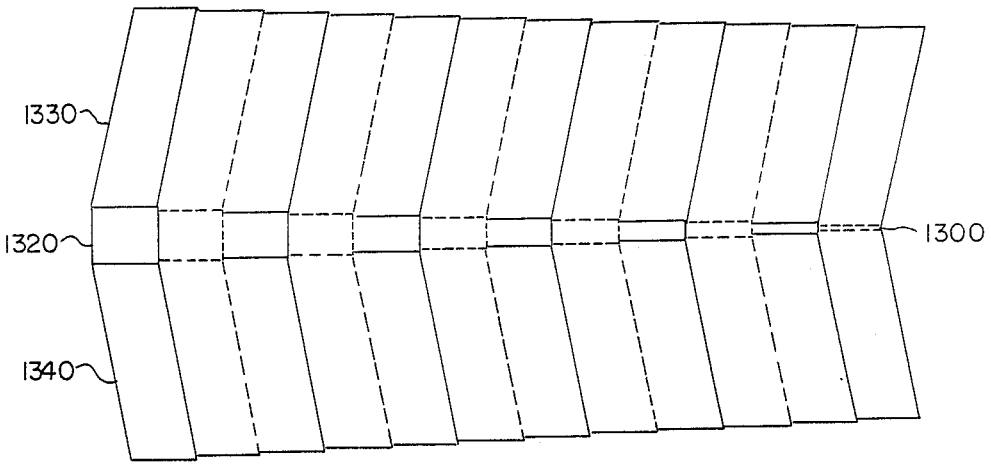
FIG. 39 shows an alternate pattern for the basic unit where the central strip is tapered in a step-like fashion.

FIG. 39 shows the unit 1300 which is comprised by a central tapered strip 1320 which is bordered by two elongated strips 1330 and 1340. In this embodiment of the invention the central strip 1320 is tapered in a step-like fashion such that the connecting lines between central tapered strip 1320 and elongated strips 1330 and 1340 are slightly offset from one another.

It will be appresicated that the instant specification and claims are set forth by way of illustration and not limitation, and that various modifications and changes may be made without departing from the spirit and scope of the present invention.

What is claimed is:

1. A unit comprised of:

a central tapered strip bordered by two elongated strips the tapered strip being pleated along a series of lines that cross it widthwise, the fold directions of said adjacent crossing lines alternating, each elongated strip being pleated along a series of crossing lines that cross the strip widthwise, the fold directions of said adjacent crossing lines alternating, these crossing lines being essentially continuations of the lines crossing the central tapered strip, the central tapered strip being joined to each of the two elongated strips by a series of pleat lines that are connected end-to-end, and the fold directions of said adjacent connecting lines alternating, such that when the unit is folded, each of the two elongated strips fold into a stack, and the central tapered strip folds in a zig-zag fashion, such that the planes of the tapered strip lie essentially orthogonal to the planes of the stacked elongated strips.

the two stacked elongated strips folding towards each other, such that the stacks lie in line with one another.

2. A reversibly expandable structure at least in part comprised of units according to claim 1.

3. A unit to claim 1, where the central tapered strip is comprised of rigid plates hingedly joined to one another, the two elongated strips are comprised of rigid plates hingedly joined to one another, and the central strip is hingedly joined to the two elongated strips.

4. A reversibly expandable structure at least in part comprised of units according to claim 3.

5. A unit according to claim 1, where the central tapered strip is comprised of a flexible sheet with rigid framing members to stiffen those areas that are between pleat lines, and the two elongated strips are comprised of flexible sheets with rigid framing members to stiffen those areas that are between pleat lines.

6. A reversibly expandable structure at least in part comprised of units according to claim 5.

7. A unit according to claim 1, where the central strip is tapered in a step-like fashion such that the connecting lines that join the central strip to the two elongated strips are offset from one another.

8. A reversibly expandable structure at least in part comprised of units according to claim 7.

* * * * *